US005388689A

United States Patent [19]

Kroop et al.

[11] Patent Number: 5,388,689

[45] Date of Patent: Feb. 14, 1995

[54] WRITING SURFACES AND CONTAINER FOR SUPPLIES

[75] Inventors: Tracy D. Kroop, North Brunswick, N.J.; Nancy A. DeBellis, Bethlehem, Pa.; Charles W. Dietterich, Brodheadsville, Pa.; Robert S. Volk, Easton, Pa.

[73] Assignee: Binney & Smith Inc., Easton, Pa.

[21] Appl. No.: 186,758

[22] Filed: Jan. 25, 1994

[51] Int. Cl.[6] ..... A45S 11/34; B65D 85/28

[52] U.S. Cl. ..... 206/214; 206/1.7; D19/78

[58] Field of Search ..... 206/1.7, 214; D19/77, D19/78, 85,

[56] References Cited

U.S. PATENT DOCUMENTS

| | | | |
|---|---|---|---|
| D. 90,769 | 9/1933 | Kamen | 19/36 |
| D. 330, 045 | 10/1992 | Dietterich et al. | D19/36 |
| D. 332,466 | 1/1993 | Logan | D19/35 |
| D. 332,468 | 1/1993 | Tarozzi | D19/85 |
| D. 334,946 | 4/1993 | Tarozzi | D19/77 |
| D. 338,496 | 8/1993 | Tarozzi | D19/85 |
| 1,193,181 | 8/1916 | Peck | 20.6/1.7 |
| 4,318,471 | 3/1982 | Hutton | D19/77 X |
| 4,927,748 | 5/1990 | Kinberg | 434/410 |
| 5,190,151 | 3/1993 | Dietterich | 206/214 |
| 5,248,030 | 9/1993 | Tarozzi | 206/1.7 |

FOREIGN PATENT DOCUMENTS

| | | | |
|---|---|---|---|
| 76808 | 9/1948 | Czechoslovakia | 206/214 |
| 27094 | 12/1954 | Finland | 206/214 |

OTHER PUBLICATIONS

Crayola® Draw 'N'Do Desk-Color Photocopy of Binney & Smith Inc. 1984 Catalog, one page.

Crayola® Deluxe Art Kit-Color Photocopy of Binney & Smith Inc. 1984 Catalog, one page.

Crayola®Coloring Tote-Color Photocopy of Binney & Smith Inc. 1984 Catalog, one page.

Crayola® Drawing Portfolio-Color Photocopy of Binney & Smith Inc. 1993 Catalog, one page.

Crayola® Fashion Designer and Vehicle Designer Lite Desk-Color Photocopy of Binney & Smith Inc. 1993 Catalog, one page.

*Primary Examiner*—William I. Price

*Attorney, Agent, or Firm*—Leydig, Voit & Mayer

[57] ABSTRACT

A writing kit comprises a base, an external wall extending in a direction generally perpendicular to the base to define a compartment, one or more wings hingeably mounted to the base, one or more writing surfaces attached to the interior wing surface of at least one wing, wherein the wings may be adjusted between an open position, one or more partially open positions, and one or more closed positions. Preferably, the kit includes four wings and four writing surfaces, one attached to each wing. The kit provides for self-contained storage of the writing surfaces and writing implements, and is suitable for use by a child.

26 Claims, 4 Drawing Sheets

WRITING SURFACES AND CONTAINER FOR SUPPLIES

FIELD OF THE INVENTION

The present invention relates to writing kits. More specifically, the invention relates to writing kits that provide a writing surface, offer closeable storage for writing utensils, and are portable. The writing kits of the present invention comprise a base, a plurality of wings hingeably mounted to the base, and an external wall extending from the base to form a compartment for storage of writing implements. One or more writing surfaces are affixed to at least one interior wing surface.

BACKGROUND OF THE INVENTION

Many people are known to enjoy drawing, sketching, and doodling. In particular, young children are known to be fond of doodling and drawing pictures. Allowing a young child to draw has several benefits. First, drawing may provide an outlet for the child to be creative and imaginative. Second, young children are extremely active. When a child is given writing materials, he may occupy himself for as long as several hours. Such activity is safe, inexpensive, and does not require keen attention of a supervising adult. Third, children are often able to communicate more readily through pictures than through words. Thus, an examination of the child's drawings may help an adult to understand the thoughts of the child more easily than through verbal communication.

A writing system may be said to comprise a writing utensil, a writing surface, and, optionally, an eraser. Elements of a writing system other than the writing surface, i.e., the writing utensil and eraser, may be referred to as writing implements. Of course, many writing systems are commonly available to children. The most commonly available writing surface is paper. Paper may be white, cream-colored, or any number of other colors, and is available both in free sheet form and as a pad, pads being preferred. When the paper is provided in the form of a pad, a child may write on the uppermost sheet of the pad, then remove this top sheet to continue drawing on the sheet below. The top sheet may be discarded or preserved for display or other use. Paper is relatively inexpensive, and amenable to be written upon by a wide assortment of writing utensils, such as crayons, markers, pens, pencils, paint sticks, and the like.

Further, many of the writing utensils suitable for use on paper allow for erasable writing. For example, pencil graphite and certain pen inks are readily erasable from most types of paper. As an eraser, a knob made of rubber or a similar material may be used.

Another widely known writing surface is a chalkboard. Chalkboards were traditionally made of slate, but today are more commonly green or black composite boards or even a plasticized polyvinyl chloride film. A chalkboard erodes chalk drawn across it and retains lightly embedded particles of embedded chalk to form a mark. White or yellow chalk is the most commonly used chalk, although colored chalks are also known.

Chalkboards have the advantage of being easily erasable with a cloth or eraser. When a full cleaning is desired, a chalkboard may be cleaned with plain water, without resort to chemical cleaners. Further advantages of chalk are that it is inexpensive, can be nontoxic, and does not have an unpleasant odor.

A third commonly known writing surface is a whiteboard. A whiteboard may be a melamine, porcelain, or enamel resin layer affixed to a substrate. Such whiteboards are characterized in that they have hard, white surfaces that are very smooth in appearance, and are essentially nonporous. In such boards, some cracks and pores are sometimes observed upon microscopic inspection.

Alternately, a whiteboard may comprise a sheet of polymeric film such as an acrylic or UV curable resin. This second type of whiteboard is characterized by having a surface of low porosity, preferably less than about 250 cc/($mm^2$·mm), 24h as measured by ASTM procedure D1434. Suitable polymeric materials include polyethylenes, polypropylenes, polyvinyl chlorides, polyesters, polyethers, polyvinylacetates, polystyrenes, cellulosics such as ethyl cellulose and cellulose acetates, and the like. As a writing utensil for use on either type of whiteboard, whiteboard markers are commonly used.

Whiteboards have several advantages. First, the markers used to write on whiteboards are comfortable, easy to use, and are available in many bright colors which are appealing to children. Second, whiteboards are easily erasable with a cloth or felt eraser. Third, whiteboards provide a white background for the child's drawings, thus making them easy for the child and others to see.

A fourth commonly available writing surface is a wipeable crayon surface. Such surfaces are commonly available and characterized as having a smooth appearance and a hard, white, nonporous surface. Wipeable crayon surfaces may be written on with crayons and easily cleaned with a cloth. One such surface comprises a plasticized polyvinyl chloride film.

Crayons are available in a vide variety of colors which are attractive and appealing to children. Further, many crayons are nontoxic and void of any unpleasant odor. Moreover, it has been observed that children particularly enjoy the texture and feel of crayons when drawing.

A fifth commonly available writing surface is an erasable adhesion writing surface. Erasable adhesion writing surfaces are characterized by having two layers. The first layer is a translucent upper layer which is typically made from a plastic film. The second layer is a rigid substrate. In one embodiment, the first layer has a light color, such as white or light grey, in which case the second layer has a dark color, such as black or dark blue. Alternately, the substrate can be a bright color, such as white, and the translucent upper layer a darker color, such as red or green. The first layer is positioned over the second layer, and the layers are affixed to each other along one of the edges. The first and second layer are of such materials so that the two layers may be caused to adhere to each other upon application of a slight pressure.

In operation, the user utilizes a blunt writing stylus to write or draw on the first layer. This presses the first layer against the second layer, and causes the first layer to adhere to the second layer. Consequently, the areas where the first layer adheres to the second layer become either dark against a bright background or light against a dark background, allowing the writing or image to be formed. The user may erase the image thus formed by separating the first layer from the second layer to remove the adhesion between the two layers.

Erasable adhesion writing surfaces have the advantages of being nontoxic and odor-free. Further, because the erasable adhesion writing surface allows the child to create a drawing that is entirely contained within the writing media, a child using an erasable adhesion writing surface will not write on walls and other inappropriate areas. Moreover, because such surfaces are easily erasable, they maintain the interest of the user for an extended period of time.

Although all of the aforementioned writing systems have their unique advantages, there are a number of drawbacks inherent in each of the foregoing writing systems. Perhaps the most significant is the clutter associated with children when they draw or doodle. Especially where markers, pens, crayons, paint sticks, or chalk is concerned, children are known to scatter these writing utensils about the room, where they may be lost or damaged, or may inadvertently mark walls, carpeting, or furniture. A related problem is the storage of the writing utensils. Where the utensils are stored separately from the writing surface, there is an increased possibility that either the writing surface or one or more of the writing utensils will be lost.

Secondly, children have a limited attention span. Although they enjoy doodling and drawing, they may become bored when using one writing system exclusively. This may lead to a child's writing on walls, furniture, or other inappropriate locations. Further, the child may eventually abandon the drawing exercise altogether, opting instead to engage in another activity that may be more dangerous or more expensive, or one that requires closer adult attention.

Third, not all of the commonly available writing systems are readily moveable. Both the writing surface and writing utensils must be packed away. This task is often a complex one for a child to master. Thus, the child may lose either the writing surface or one or more writing utensils.

Fourth, not all of the widely available writing systems are portable. "Portable" is the amenability of the writing system to be used while travelling, for example, in the back seat of an automobile. Such portability is a desirable feature in a writing system, for example, for use during long automobile, plane, or train trips.

OBJECTS OF THE INVENTION

It is an object of the present invention to provide a writing kit that alleviates the clutter commonly associated with conventional marking systems.

Another object of the present invention is to provide a writing kit that will maintain a child's attention for a long period of time.

It is a further object of the present invention to provide a writing kit that is readily moveable.

Still another object of the present invention is to provide a writing system that is portable.

An additional object is to provide a writing kit that has several different writing implements and writing surfaces.

Yet another object of the present invention is to provide a writing system that allows for self-contained storage of both the writing implements and the writing surface.

All of these objects are realized in whole or part by one or more embodiments of the present invention.

SUMMARY OF THE INVENTION

The present invention concerns a writing kit that comprises a base, a plurality of wings hingeably mounted to the base, and an external wall extending from the base to form a compartment for storage of writing implements. One or more writing surfaces are affixed to at least one interior wing surface. Preferably, two or more different writing surfaces are employed.

The wings are moveable between an open position, one or more partially open positions, and one or more closed positions. When in the open position, the compartment is accessible so that the child may retrieve or store the writing utensils. Additionally, when in this position, all of the writing surface may be exposed for use by the child, or, alternatively, one or more of the writing surfaces may be folded under the base, so that the writing kit may be used in a confined space. When in at least one of the closed positions, the wings are detachably secured to allow for portability of the writing kit and convenient storage of the writing implements.

DETAILED DESCRIPTION OF THE PREFERRED EMBODIMENT

Figure 1:
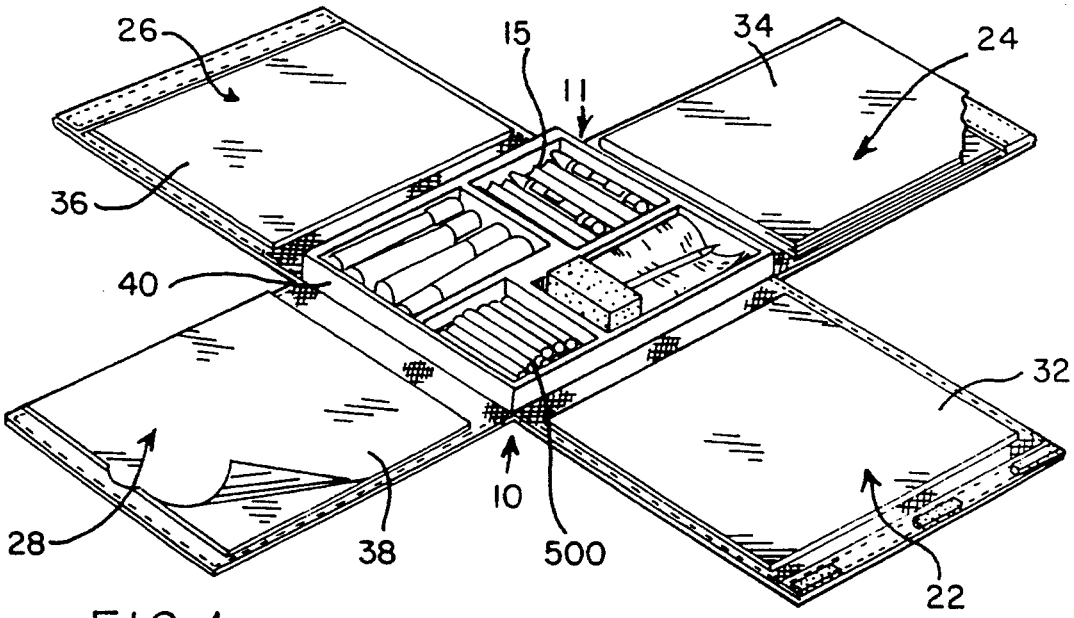
FIG. 1 is a perspective view of a writing kit according to the present invention when in the open position.
Figure 3:
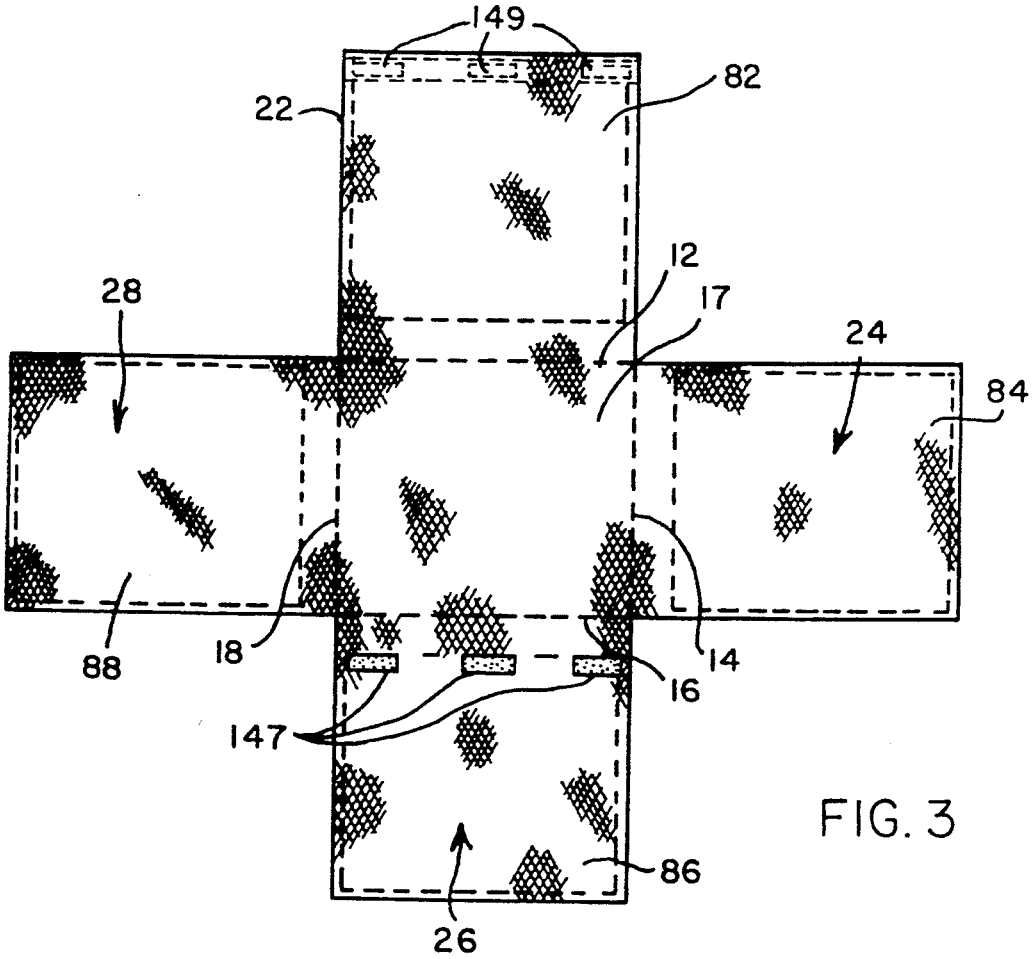
FIG. 3 is a bottom plan view of the writing kit illustrated in FIG. 1.
Figure 9:
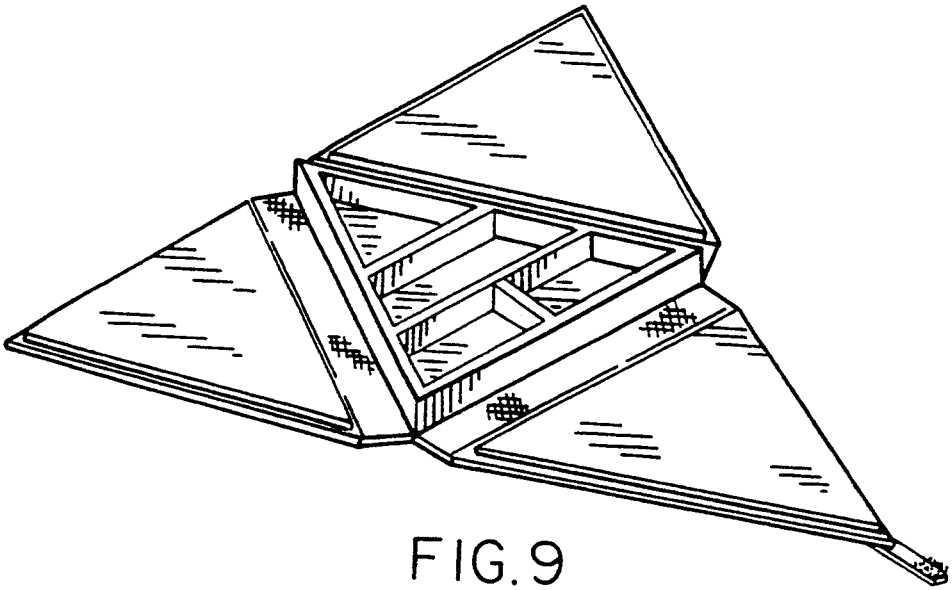
FIG. 9 is a perspective view of a first alternate embodiment of the writing kit when in the open position.
Figure 10:
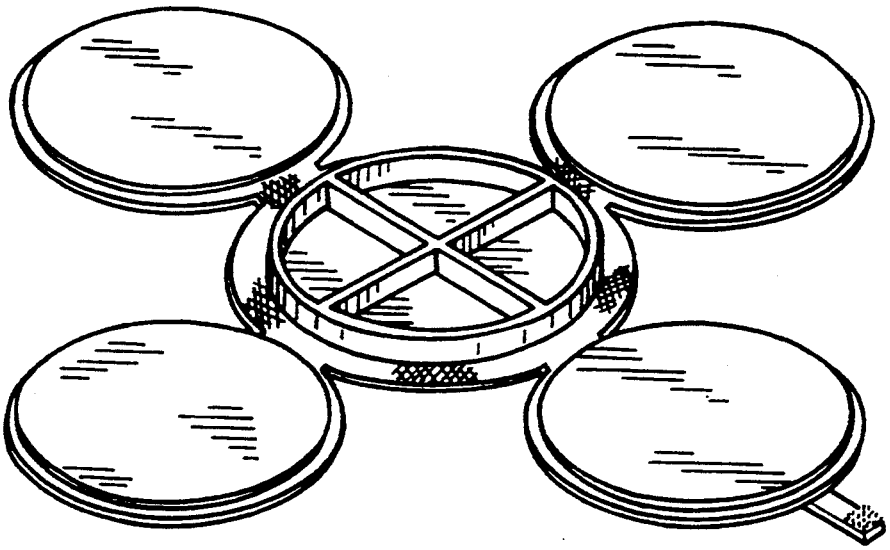
FIG. 10 is a perspective view of a second alternate embodiment of the writing kit when in the open position.

With reference to FIGS. 1 and 3, kit 10 comprises a base 11 having an interior base surface 15, an exterior base surface 17, and a plurality of wings 22, 24, 26, and 28 hingeably mounted to the base. Preferably, the kit is as shown in FIG. 1; i.e., the base 11 has a generally square shape. However, one skilled in the art will recognize that the base may have a variety of shapes, such as triangular, circular, and so forth, as illustrated in FIGS. 9 and 10. Innumerable base shapes are possible. As illustrated in FIG. 1, an external wall 40 extends from the base 11 in a direction generally perpendicular to interior base surface 15. One or more writing surfaces 32, 34, 36, and 38 are affixed to wings 22, 24, 26, 28.

Figure 2:
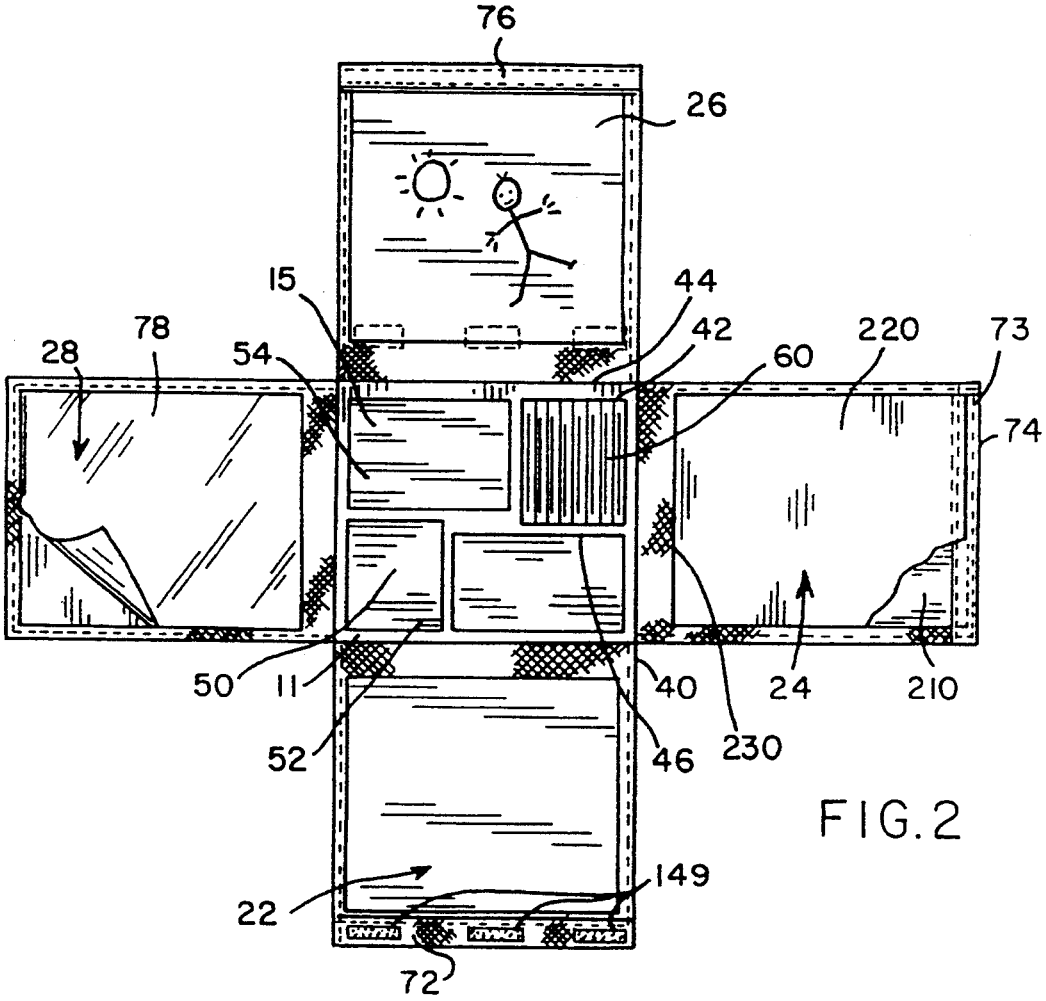
FIG. 2 is a top plan view of the writing kit illustrated in FIG. 1.

The invention will be more clearly understood with reference to FIGS. 2 and 3. The base 11 has an interior base surface 15, an exterior base surface 17, and a plurality of base edges 12, 14, 16, 18. The external wall 40 has an interior face 42 and an exterior face 44. The interior face 42 and the interior base surface 15 define a compartment 50. Preferably, one or more interior walls 46 extending from base 11 in a direction generally perpendicular to interior base surface 15 define one or more subcompartments 52, 54 with the interior face 42 and the interior base surface 15. Potentially, the interior base surface 15 contains ridges 60 in at least one area of internal base surface 15, said ridges 60 adapted to receive writing utensils 500 or other writing supplies, such as erasers, cloths, and the like, as illustrated in FIG. 1. The ridges can include any recess, perforation, or chamber adapted to receive writing implements or supplies.

Referring again to FIGS. 2 and 3, a plurality of wings 22, 24, 26, 28 are hingeably mounted to base 11 at base edges 12, 14, 16, 18. Preferably, one wing is hingeably mounted at each base edge. Each wing 22, 24, 26, 28 has an interior wing surface 72, 74, 76, 78 and an exterior wing surface 82, 84, 86, 88. One or more writing surfaces 32, 34, 36, 38 are affixed to at least one interior wing surface 72, 74, 76, 78. Alternately, the wings 22, 24, 26, 28 can be made of a material which can be used as a writing surface and eliminates the need for separate writing surfaces. Preferably, more than one writing surface is included. More preferably, four writing surfaces 32, 24, 36, 38 are included, wherein each writing surface is affixed to a separate interior wing surface. Most preferably, each writing surface is a different writing surface, selected from the group consisting of a wipeable crayon surface, a pad of paper, a chalkboard, a whiteboard, an erasable adhesion writing surface.

The manner in which writing surfaces 32, 34, 36, 38 are affixed to wings 22, 24, 26, 28 is not subject to any particular limitation. Where the writing surface is other than a pad of paper, it is preferred that the writing surface is not readily detachable from the wing, thereby preventing a child from detaching and possible harming or losing the writing surface. For example, the writing surface may be affixed to the interior wing surface. Methods of affixing may include gluing, sewing, or attachment by fasteners such as clips and staples. The writing surface may be attached by the manufacturer, or may be supplied separately for attachment by the customer. For example, the writing surface may be supplied with an adhesive backing, which is covered by a protective sheet. The customer would remove the protective sheet and attach the writing surface to the wing. Alternately, the writing surface itself may act as a wing. For example, if the writing surface is a chalkboard, the chalkboard may be fashioned into the shape of a wing, and hingeably mounted to the base in the same manner as the other wings. Thus, the interior surface of the wing will include the chalkboard as a writing surface.

Where the writing surface is a pad of paper, such as writing surface 34 in FIG. 1, it is preferable that the pad be readily removable, so that the paper supply may be replenished. For example, the wing may contain a sleeve through which the pad 34 may be inserted, thus allowing for frictional retention of the pad within the sleeve. Alternately, the pad 34 can be attached by means of removable fasteners, such as clips. In a preferred embodiment, as illustrated in FIGS. 1 and 2, the wing has a pocket 73 into which backing 210 may be inserted opposite binding 230. In this embodiment, pages 220 preferably cover pocket 73 until the paper supply has been depleted.

Figure 6:
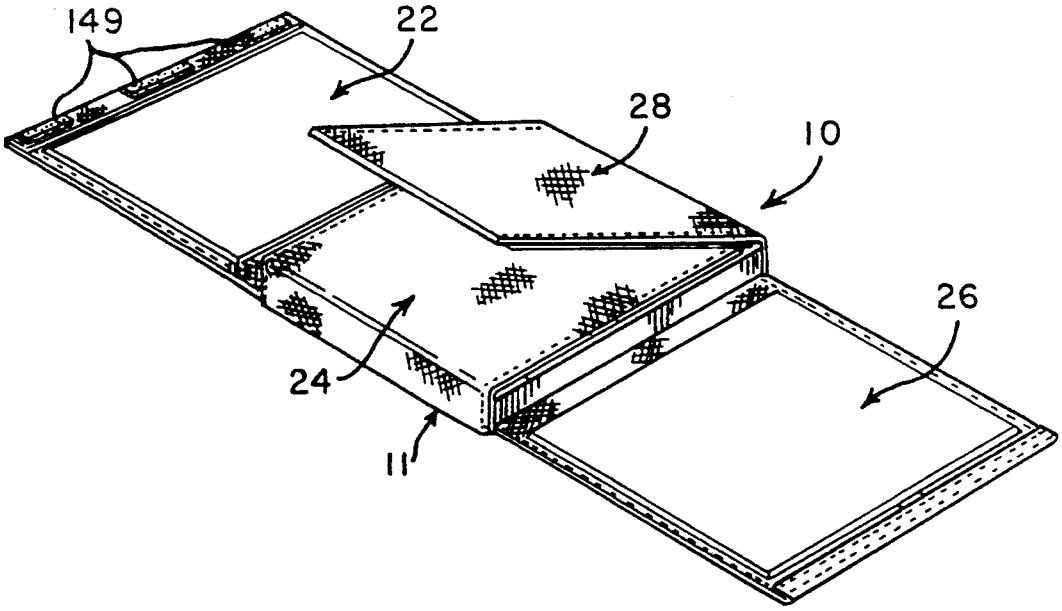
FIG. 6 is a perspective view illustrating the beginning of the process for closing the writing kit illustrated in FIG. 1.
Figure 7:
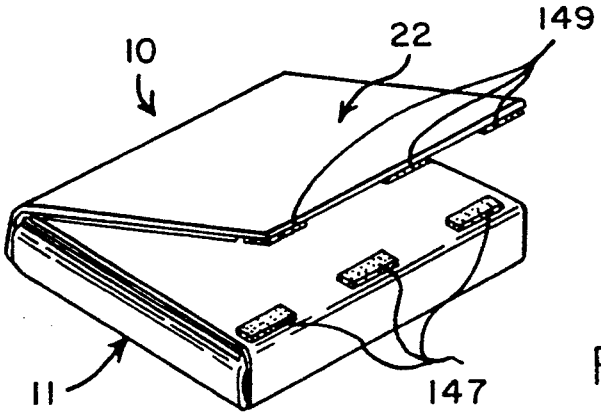
FIG. 7 is a perspective view of the writing kit illustrated in FIG. 1 when in a partially open position; further, this view illustrates the process of closing as continued from FIG. 6.
Figure 8:
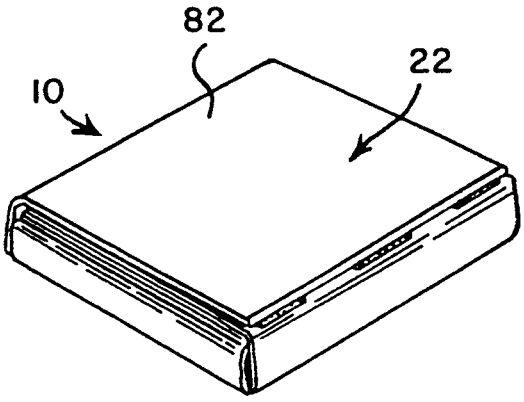
FIG. 8 is a perspective view of the writing kit illustrated in FIG. 1 when fully closed.

When the base is square, preferably the number of wings extending from the base is four, as shown in FIG. 1. However, it will be apparent that a different number of wings may extend from the base. The number of wings need not correspond to the number of sides of the base. Preferably, each wing has a slightly rectangular shape, such that each may be folded over external wall 40 and base 11 to a resting position in which the wing covers base 11, as illustrated by FIGS. 6 and 7. Of course, the shape of the wings is not subject to any limitation. For example, the wings may be circular, or may have a polygonal shape, such as triangular, as illustrated in FIG. 9; circular, as illustrated in FIG. 10; pentagonal, and so forth. The shape of the wings need not be identical to the shape of the base. It is only necessary that the wings be foldable into at least one closed position in which one or more wings covers the compartment 50.

Figure 4:
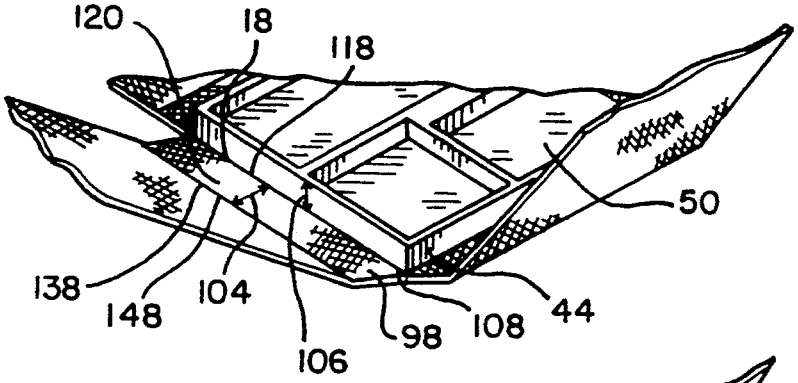
FIG. 4 is a fragmented perspective view of a first embodiment of the kit in the open position.
Figure 5:
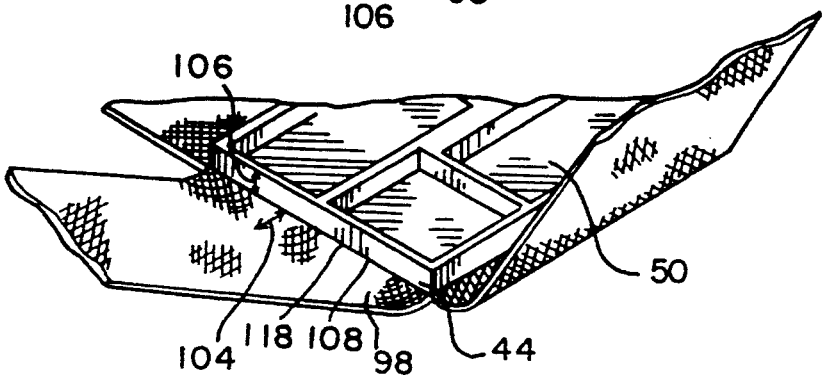
FIG. 5 is a fragmented perspective view of a second embodiment of the kit in the open position.

The manner in which the wings 22, 24, 26, 28 are hingeably mounted to base edges 12, 14, 16, 18 can be understood more clearly with reference to FIGS. 2, 4, and 5. With reference to wing 28, this wing has a flexible portion 98, having a flexible portion edge 108. The width 104 of the flexible portion 98 is at least equal to the height 106 of the exterior wall 40. Flexible portion edge 108 engages base edge 18 in a manner allowing wing 28 to be movably positionable in an arc with respect to base edge 18. It is thus seen that this engagement forms hinge 118. Similarly, hinges are formed by the engagement of flexible portion edges on wings 22, 24, 26 with base edges 12, 14, and 16.

The construction of flexible portion 98 and the flexible portions on wings 22, 24, 26 is not critical, so long as at least one, and preferably all, of wings 22, 24, 26, 28 may be folded over external wall 40 and base 11 in the manner depicted by FIGS. 6 and 7. With reference to wing 28, one embodiment of flexible portion 98 is illustrated by FIG. 5. In this embodiment, flexible portion 98 is a strip of fabric that easily flexes without breaking. Suitable as the fabric of flexible portion 98 are such materials as cloth, nylon, plastic, rubber, paper, and so forth. Preferably, nylon fabric is used.

In this particular embodiment, the interior surfaces are made of vinyl and the exterior surfaces are made of nylon. The nylon and vinyl are sewn together along the edges and a chip board material is positioned between the nylon and vinyl to provide a rigidity to the wings and base. In addition, the base may include a separate tray which is made of vacuum formed plastic. The tray includes two wings which are inserted into two pockets on the base which are similar to the pocket 73.

In this embodiment, wing 28 is preferably entirely constructed of the fabric of flexible portion 98. In such case, writing surface 38 (not shown in FIG. 5) is affixed to wing 28 at a distance equal to width 104 from base edge 18. Thus, it will be apparent that this allows the user to fold wing 28 over external wall 40 and base 11 to a resting position in which it covers base 11. The user first rotates wing 28 about flexible portion edge 108. Because width 104 is at least equal to height 106, flexible portion 98 coincides with exterior face 44 of external wall 40, allowing the child to then fold the remaining portion of wing 28 over base 11. Preferably, wing 28 is of sufficient dimensions as to cover compartment 50, thus allowing the child to store writing implements 500. Wings 22, 24, 26 are similarly constructed.

A second embodiment of flexible portion 92, 94, 96, 98 is depicted by FIG. 4. Referring again to wing 28, flexible portion 98 comprises a strip 120 engaging base edge 18 at hinge 118, which, in this embodiment, is a first living hinge. Strip 120 has a second living hinge 138 at interior hinge line 148, wherein interior hinge line 148 is located at width 104 from flexible portion edge 108. It is thus apparent that, in closing wing 28 over external wall 40 and base 11, the user first rotates wing 28 about first living hinge 118 such that wing 28 is essentially normal to the plane of base 11, thus allowing strip 120 to coincide with external wall 40. Second, the user rotates wing 28 about second living hinge 138 such that wing 28 is caused to fold over external wall 40 and base 11 to come to a resting position in which wing 28 covers base 11.

The construction of strip 120 and wing 28 is not subject to any particular limitation. For example, strip 120 and living hinges 118 and 138 may be made of plastic, using injection molding processes. Wings 22, 24, 26 are similarly constructed.

Of course, the embodiments of flexible portions 92, 94, 96, 98 are not limited to the embodiments of FIGS. 4 and 5. It is only necessary of the flexible portion that it allows the child to fold the wing to which it is attached over external wall 40 and base 11, preferably such that the wing comes to a resting position in which it covers base 11.

With reference to FIGS. 6 and 7, operation of the kit will be apparent. The wings 22, 24, 26, 28 are moveable between an open position, one or more partially closed positions, and one or more closed position. When wings 22, 24, 26, 28 are in the open position, none of wings 22, 24, 26, 28 cover base 11. The partially open positions may be defined as those positions in which one or more wings 22, 24, 26, 28, but not all of wings 22, 24, 26, 28, cover base 11. Thus, where a kit has four wings, one, two, or three of wings 22, 24, 26, 28 may cover base 11 when in a partially open position. The closed positions are those positions in which all of wings 22, 24, 26, 28 cover base 11.

One skilled in the are will appreciate that, where the kit contains four wings, there are thirty-six partially open positions and twenty-four closed positions possible. This multitude of positions results from the possible permutations of open and closed wings. For example, to obtain a closed position, wing 22 may be first be folded over external wall 40 and base 11 to cover base 11. If wings 24, 26, and 28 are subsequently folded over external wall 40 and base 11, the wings will then be in a closed position. A second closed position may be obtained by first folding wing 22, then folding wings 26, 24, and 28 in respective order. This multiplicity of positions has the advantage of allowing the user to experiment with the various permutations, thus further preventing the user from becoming bored. If one of the wings 22, 24, 26, 28 has a logo or other writing designed to be viewed when the wings have been folded into a closed position, then preferably that wing is to be folded over external wall 40 and base 11 after all other wings have been so folded.

Preferably, when in one or more closed positions, closing means adapted to secure the kit are included in the kit. FIGS. 2 and 3 illustrate the preferred closing means, which are a first gripping element 147 attached to the exterior wing surface 86 of wing 26 and a second gripping element 149 attached to the interior wing surface 72 of wing 22, wherein said gripping elements are mateably engageable. Suitable materials for said gripping elements include hook and loop fasteners. The first and second gripping elements 147, 149 are capable of detachably securing wing 22 to wing 26, thus effecting a closure of kit 10.

One skilled in the art will appreciate that, when first and second gripping elements 147, 149 are used, the wings should preferably be folded in a manner that will allow the first and second gripping elements 147, 149 to engage. When first gripping element 147 is attached to exterior wing surface 86 of wing 26 and second gripping element 149 is attached to interior surface 72 of wing 22, as shown in FIGS. 2 and 3, there are two equally preferred closed positions obtained as follows: First, either wing 24 or wing 28 is folded over external wall 40 to cover base 11. Second, the remaining wing of wings 24 and 28 is folded to cover base 11. Third, wing 22 is folded over external wall 40 to cover base 11. Finally, wing 26 is folded to cover base 11. If a logo or other illustration is to be viewed when the wings have been folded into a closed position, it is thus to be placed on exterior wing surface 86 of wing 26.

Of course, the positions of the first and second gripping elements are not critical, so long as they enable the user to detachably secure the wings. For example, the gripping elements may be placed on interior wing surface 76 of wing 26 and exterior wing surface 88 of wing 28. Further, the closing means are not limited to the mateably engageable gripping elements disclosed above. Any suitable means may be employed, so long as the wings are detachably securable when in a closed position. For example, buttons, snaps, straps, and other closing means may be used.

Thus, the kit is preferably operated as follows. The user manipulates the wings 22, 24, 26, 28 to the open position when use of the kit is desired. After marking one or more writing surfaces 32, 34, 36, 38 with writing implements 500, the child replaces writing implements 500 in ridges 60 and folds wings 22, 24, 26, 28 over external wall 40 and base 11 in the preferred order as previously specified, causing first and second gripping means 147, 149 to engage.

An alternate method of use is to operate the kit in a partially open position. For example, if the user desires to use writing surface 34, he may close wings 22, 26, and 28 and rotate wing 24 past 180° with respect to the base to a position in which exterior wing surface 82 coincides with exterior base surface 17. Inverting the entire assembly 10 allows the child to mark writing surface 34 with the kit in a partially open position. This position has particular application when the kit is to be used in a confined space, such as the rear seat of an automobile. The user then folds wings 22, 24, 26, 28 over external wall 40 and base 11 in the manner previously described.

Because the kit is self-contained, a user will easily be able to replace the writing implements when the user has finished using the kit. One skilled in the art will thus appreciate that the kit of the present invention is portable, moveable, and provides for self-contained storage of both the writing implements and writing surfaces. Further, because the writing implements and writing surfaces are self-contained when the wings have been folded into a closed position, the user will not create such a clutter as if the user were using a conventional writing system. Moreover, because of the multiple writing surfaces contained within the present kit and the multiple wing-folding permutations, the user will be occupied for many hours when using the kit, and will not become bored.

While particular embodiments of the invention have been shown, it will of course be understood that the invention in not limited thereto since modifications may be made by those skilled in the art, particularly in light of the foregoing teachings. It is, therefore, contemplated by the appended claims to cover any such modifications as incorporate those features which constitute the essential features of these improvements within the true spirit and scope of the invention.

What is claimed is:

1. A writing kit comprising:

a base having a plurality of base edges, an interior base surface, and an exterior base surface;

a plurality of wings, each of said wings having an interior wing surface, and an exterior wing surface, each of said wings having a flexible portion, wherein said flexible portion engages a base edge, whereby the wings are hingeably moveable between an open position and a closed position, wherein at least one of said interior wing surfaces includes a writing surface;

an external wall extending in a direction generally perpendicular to the internal base surface, said external wall and said interior base surface defining a compartment;

closing means, whereby the wings are detachably securable in the closed position.

2. A writing kit according to claim 1, wherein the flexible portion is a fabric strip.

3. A writing kit according to claim 1, wherein the flexible portion comprises a strip, a first living hinge, and a second living hinge.

4. A writing kit according to claim 1, wherein said writing surface is selected from the group consisting of a pad of paper, a chalkboard, a whiteboard, a wipeable crayon surface, and an erasable adhesion writing surface.

5. A writing kit according to claim 1, wherein at least two of said interior wing surfaces include a writing surface.

6. A writing kit according to claim 5, wherein said writing surfaces are the same or different and are selected from the group consisting of a pad of paper, a chalkboard, a whiteboard, a wipeable crayon surface, and an erasable adhesion writing surface.

7. A writing kit according to claim 1, wherein at least four of said interior wing surfaces include a writing surface.

8. A writing kit according to claim 7, wherein said writing surfaces are the same or different and are selected from the group consisting of a pad of paper, a chalkboard, a whiteboard, a wipeable crayon surface, and an erasable adhesion writing surface.

9. A writing kit according to claim 1, wherein the interior base surface contains ridges adapted to receive writing utensils.

10. A writing kit according to claim 1, wherein said closing means comprise a first and a second gripping element, said first and second gripping elements being mateably engageable, said first gripping element attached to the interior wing element of a first wing, said second gripping element attached to the exterior wing element of a second wing, whereby the first gripping element engages the second gripping element when the wings are in a closed position, thereby detachably securing the wings in the closed position.

11. A writing kit according to claim 1, wherein said writing surface is selected from the group consisting of a pad of paper, a chalkboard, a whiteboard, a wipeable crayon surface, and an erasable adhesion writing surface; wherein said closing means comprise a first and a second gripping element, said first and second gripping elements being mateably engageable, said first gripping element attached to the interior wing element of a first wing, said second gripping element attached to the exterior wing element of a second wing, whereby the first gripping element engages the second gripping element when the wings are in a closed position, thereby detachably securing the wings in the closed position.

12. The invention as in claim 1 wherein said interior base surface is removable.

13. The invention as in claim 1 wherein said exterior wing surface is sewn to said interior wing surface.

14. The invention as in claim 13 wherein said exterior wing surface is made of nylon and said interior wing surface is made of vinyl.

15. The invention as in claim 13 wherein a rigid material is positioned between said exterior wing surface and said interior wing surface.

16. The invention as in claim 1 wherein said writing surface is attached to said interior wing surface.

17. A writing kit comprising:

a base having four edges, an interior base surface, and an exterior base surface;

a first, second, third, and fourth wing, each of said wings having an interior wing surface and an exterior wing surface, each of said wings having a flexible portion, said flexible portion having a flexible portion edge, wherein each of said flexible portion edges engages a base edge at a hinge, whereby the wings are hingeably moveable between an open position and a closed position;

an external wall extending in a direction generally perpendicular to the internal base surface, said external wall and said interior base surface defining a compartment, said external wall having an inner face and an outer face;

an internal wall extending in a direction generally perpendicular to the internal base surface, whereby said inner face of said external wall, said internal base surface, and said internal wall define a subcompartment;

four writing surfaces, wherein each of said writing surfaces are included at the internal surface of a wing, each of said internal surfaces of said wings having at least one writing surface included therein; and a closing means for detachably securing the wings in the closed position.

18. A writing kit according to claim 17, wherein the flexible portion is a fabric strip.

19. A writing kit according to claim 17, wherein the flexible portion comprises a strip, a first living hinge, and a second living hinge.

20. A writing kit according to claim 17, wherein the interior base surface contains ridges adapted to receive writing utensils.

21. A writing kit according to claim 17, wherein said writing surfaces are the same or different and are selected from the group consisting of a pad of paper, a chalkboard, a whiteboard, a wipeable crayon surface, and an erasable adhesion writing surface.

22. A writing kit according to claim 17, wherein said closing means comprise a first and a second gripping element, said first and second gripping elements being mateably engageable, said first gripping element attached to the interior wing element of a first wing, said second gripping element attached to the exterior wing element of a second wing, whereby the first gripping element engages the second gripping element when the wings are in a closed position, thereby detachably securing the wings in the closed position.

23. A writing kit according to claim 17, wherein said writing surfaces are the same or different and are selected from the group consisting of a pad of paper, a chalkboard, a whiteboard, a wipeable crayon surface, and an erasable adhesion writing surface; wherein said closing means comprise a first and a second gripping element, said first and second gripping elements being mateably engageable, said first gripping element attached to the interior wing element of a first wing, said second gripping element attached to the exterior wing element of a second wing, whereby the first gripping element engages the second gripping element when the wings are in a closed position, thereby detachably securing the wings in the closed position.

24. A writing system comprising the writing kit of claim 17 and one or more writing implements.

25. A writing system according to claim 24, wherein said writing utensils are the same or different and are selected from the group consisting of crayons, markers, styluses, chalk, pencils, paints, cloths, sponge erasers, and rubber erasers.

26. A writing system according to claim 24, wherein said writing surfaces are the same or different and are selected from the group consisting of a pad of paper, a chalkboard, a whiteboard, a wipeable crayon surface, and an erasable adhesion writing surface.

* * * * *

UNITED STATES PATENT AND TRADEMARK OFFICE

CERTIFICATE OF CORRECTION

PATENT NO. : 5,388,689

DATED : February 14, 1995

INVENTOR(S) : Tracy D. Kroop et al.

It is certified that error appears in the above-indentified patent and that said Letters Patent is hereby corrected as shown below:

Column 5, line 27, delete "24" and substitute therefor --34--

Column 7, line 40, delete "are" and substitute therefor --art--

Column 7, line 45, delete the first occurrence of "be"

Column 9, line 3, delete "in" and substitute therefor --is--

Signed and Sealed this

Sixth Day of June, 1995

Bruce Lehman

*Attest:*

BRUCE LEHMAN

*Attesting Officer*

*Commissioner of Patents and Trademarks*